US010981407B2

(12) United States Patent
Abood et al.

(10) Patent No.: US 10,981,407 B2
(45) Date of Patent: Apr. 20, 2021

(54) COMBINATION GREETING CARD AND SHIPPING LABEL

(71) Applicant: GourmetGiftBaskets.com, Inc., Exeter, NH (US)

(72) Inventors: Ryan Abood, Exeter, NH (US); Glenn Schaffher, Duxbury, MA (US); Jason Bergeron, Bedford, NH (US)

(73) Assignee: GOURMETGIFTBASKETS.COM, INC., Exeter, NH (US)

( * ) Notice: Subject to any disclaimer, the term of this patent is extended or adjusted under 35 U.S.C. 154(b) by 0 days.

(21) Appl. No.: 16/243,235

(22) Filed: Jan. 9, 2019

(65) Prior Publication Data

US 2019/0263168 A1 Aug. 29, 2019

Related U.S. Application Data

(60) Provisional application No. 62/615,654, filed on Jan. 10, 2018.

(51) Int. Cl.

| | |
|---|---|
| ***B42D 15/08*** | (2006.01) |
| ***G09F 3/10*** | (2006.01) |
| ***G09F 3/00*** | (2006.01) |
| ***G09F 1/04*** | (2006.01) |
| *G09F 3/02* | (2006.01) |

(52) U.S. Cl.

CPC ..... *B42D 15/08* (2013.01); *G09F 1/04* (2013.01); *G09F 3/0288* (2013.01); *G09F 3/10* (2013.01); *G09F 2003/0202* (2013.01); *G09F 2003/022* (2013.01); *G09F 2003/0222* (2013.01); *G09F 2003/0269* (2013.01)

(58) Field of Classification Search

CPC ..... B65D 27/34; B42D 15/08
USPC ..... 40/124.11
See application file for complete search history.

(56) References Cited

U.S. PATENT DOCUMENTS

| | | | | |
|---|---|---|---|---|
| 5,022,683 | A * | 6/1991 | Barbour | B42D 15/0053 229/71 |
| 5,509,694 | A * | 4/1996 | Laurash | B42D 15/006 283/101 |
| 5,702,127 | A * | 12/1997 | Korondi, Jr. | G09F 3/0288 281/2 |
| 7,861,441 | B1 * | 1/2011 | Hoellwarth | B42D 15/08 229/92.8 |
| 2009/0101697 | A1 * | 4/2009 | Yost | B42D 15/08 229/92.1 |
| 2014/0147612 | A1 * | 5/2014 | Panunto | G09F 3/10 428/43 |

* cited by examiner

*Primary Examiner* — Joanne Silbermann
(74) *Attorney, Agent, or Firm* — Bourque & Associates

(57) ABSTRACT

A combination shipping label and greeting card in which the entire printable surface of the greeting card is exposed and customizably printable by the shipper to include both shipping information as well as a customizable logo or photo and a personalized greeting selected by the sender if desired, all of which can be printed by the shipper utilizing a conventional laser printer for example. The back of the greeting card portion may be pre-printed with the shipper's or sender's general information or any other information the shipper/sender feels is desirable such as advertising or the like.

9 Claims, 7 Drawing Sheets

COMBINATION GREETING CARD AND SHIPPING LABEL

CROSS REFERENCE TO RELATED APPLICATION

This application claims priority to U.S. Patent Application No. 62/615,654 filed on Jan. 10, 2018 entitled "COMBINATION GREETING CARD AND SHIPPING LABEL", which is incorporated fully herein by reference.

TECHNICAL FIELD

The present invention relates to shipping labels for packages and more particularly, relates to a combination shipping label and greeting card which is utilized initially as a shipping label and once opened, becomes a greeting card.

BACKGROUND INFORMATION

Companies and individuals that ship packages must include a shipping label on the outside of the package to indicate to whom the package is going. However, the same companies and/or individuals or customers of these companies and/or individuals often want to include some sort of greeting or gift indication to the intended recipient. This is especially true of companies and individuals sending gift packages or gift baskets through third parties.

Currently, shipping labels either do not include any capability of adding a greeting or message card or alternatively, such a greeting or message card is greatly limited either in size or printing orientation. In some situations, a greeting card/element may be provided however, the printing surface of this greeting card/element is limited to one side of the shipping label stock due to technical requirements to provide the shipping label with sufficient adhesive and a silicone coated removable shipping label adhesive protector on which no printing can be provided on one entire surface of a multi-fold label for example.

Accordingly, what is needed is a combination shipping label/greeting card that can be easily generated/printed with a shipping label and customized greeting utilizing standard printer technology currently owned by most companies and/or individuals. Moreover, such a combination shipping label/greeting card should include the ability to print on both sides of the greeting card portion of the combination shipping label/greeting card.

SUMMARY OF THE INVENTION

The present invention features a combination shipping label and greeting card, configured for attachment to a shipping package. The combination shipping label and greeting card comprises a single, unitary, printable sheet of material, and comprises a greeting card portion and a shipping label portion. The greeting card portion is configured for being folded and stored under at least a portion of the shipping label portion during shipping.

The shipping label portion has a top surface portion and a bottom surface portion. The top surface portion is configured to receive printed shipping information while the shipping label portion bottom surface includes at least one region on which is disposed an adhesive material. The adhesive material is configured for affixing the shipping label portion to a shipping package. The bottom surface further includes a removable release layer, configured for covering the adhesive material and for preventing the adhesive material on from adhering to an object prior to its intended use of affixing the shipping label portion to the shipping package.

In the preferred embodiment, the single, unitary, printable sheet of material is made from card stock material. The greeting card portion preferably includes at least one fold line configured for allowing the greeting card portion to be folded.

In one embodiment, the greeting card portion is detachable from the shipping label portion by means of a perforation between the greeting card portion and the shipping label portion. In another embodiment, the greeting card portion includes at least one fold line configured for allowing the greeting card portion to be folded and is attached to the shipping label portion utilizing a plurality of foldable hinges.

In one embodiment, the entire shipping label portion bottom surface includes adhesive material on which is disposed the removable release layer, and wherein the removable release layer is configured for being removed from only a portion of the bottom surface of the shipping label portion for affixing the shipping label portion to the shipping package.

In one embodiment, the shipping label portion includes at least two slots cut into the shipping label portion and extending from the bottom surface through the top surface. The two slots are disposed diagonally opposite one another and configured for allowing first and second corner regions of the detached greeting card portion to be inserted into the two slots, for holding the greeting card portion under the shipping label portion during shipping and prior to release by an end user.

The shipping label portion preferably includes a removable region configured for allowing an end user to access the greeting card portion disposed under the shipping label portion.

In each embodiment, at least the top surface of the shipping label portion and at least one surface of the greeting card portion are configured for being printed on demand prior to the shipping label portion being attached to the shipping package.

THE BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1A:
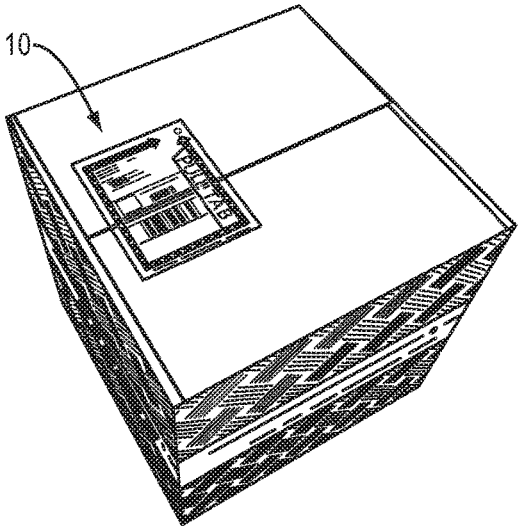
FIGS. 1A-1D are a series of photos illustrating the combination shipping label and greeting card according to the present invention.
Figure 1B:
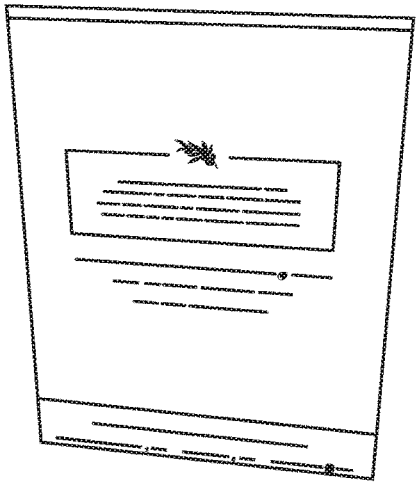
Figure 1C:
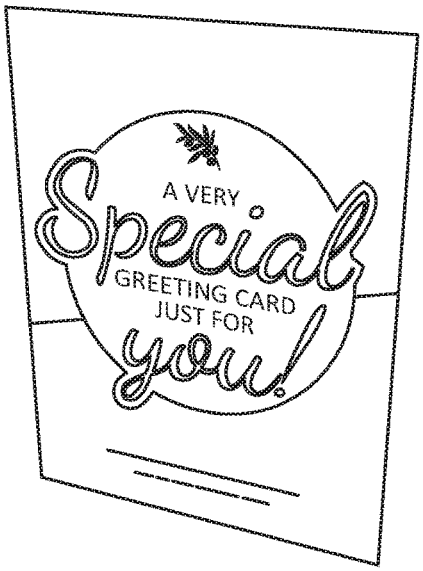
Figure 1D:
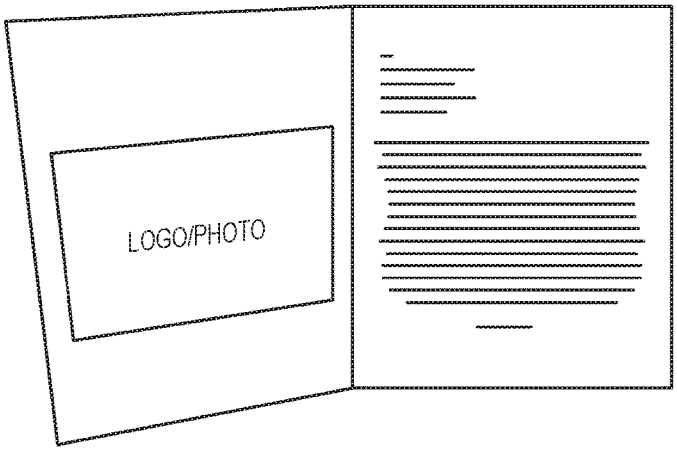

The present invention features, in a first embodiment, a combination greeting card and shipping label 10, FIG. 1 which serves as a shipping label as shown in FIG. 1A as well as including a greeting card as shown in FIGS. 1B-1D. One feature of the present invention is that the greeting card portion of the combination greeting card and shipping label can be printed on both sides and customizably printed on demand by the shipper at least on one side. For example, FIG. 1C shows a front side of a printed greeting card; FIG. 1B shows the back side of a greeting card portion of the invention; and FIG. 1D shows the inside portion of the greeting card with a customizable message.

As shown in FIG. 2, the combination shipping label and greeting card according to the present invention includes 2 portions that are initially attached proximate one edge of the 2 portions. The first portion is the shipping label portion 12 and a second portion is the greeting card portion 14 which includes a fold line 16.

The entire combination greeting card and shipping label 10 is preferably made of card stock, also often called cover stock or pasteboard, which is generally known as paper stock that is thicker and more durable than normal writing or printing paper, but thinner and more flexible than other forms of paperboard.

Figure 5:
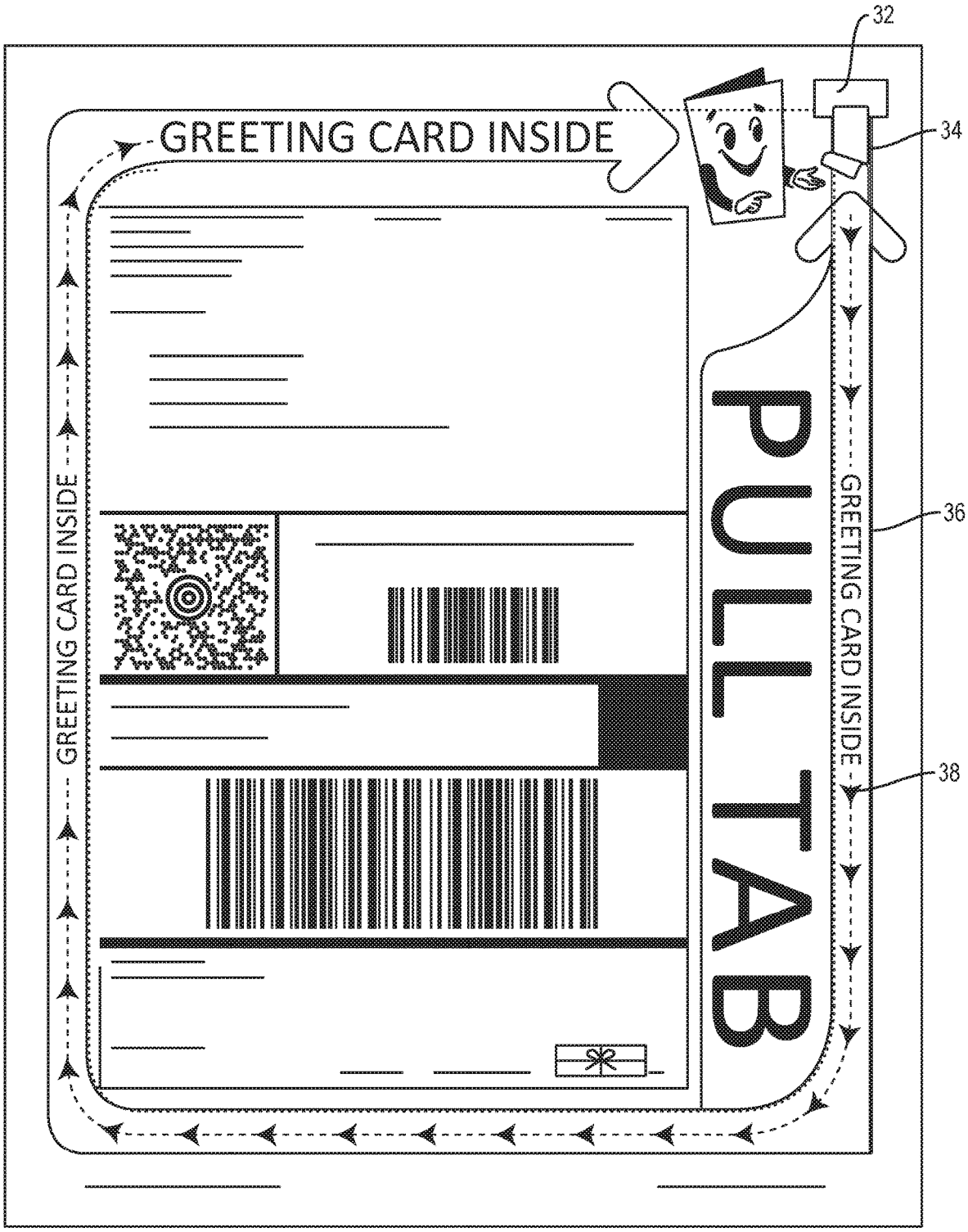
FIG. 5 is a front view of the combination greeting card and shipping label according to the present invention in a folded condition.
Figure 8:
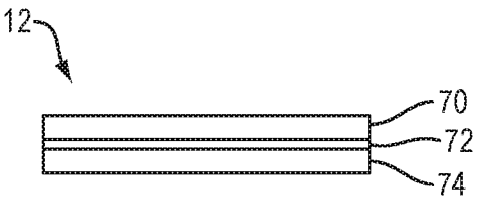
FIG. 8 is a cross-sectional view of the various layers comprising the shipping label portion according to one feature of the present invention.

At least the shipping label portion is in essence a self-adhesive label comprised of a face layer 70, FIG. 8, on which is printed shipping information as shown in FIG. 5; an adhesive layer 72 which allows the self-adhesive label to be attached to a package such as an envelope, box or the like; and a backing layer 74 which covers the adhesive layer 72 and which is typically a paper layer coated with silicone, to keep the label from sticking to objects before its intended use, as is well known in the art of self-adhering labels.

Figure 2D:
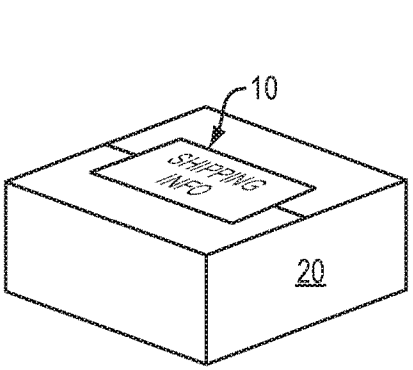
FIGS. 2A-2D are a series of illustrations showing one embodiment of a Z-fold folding method according to one embodiment of the present invention.
Figure 2C:
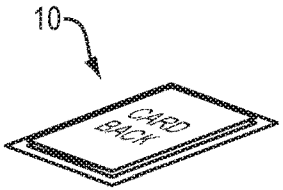
Figure 2B:
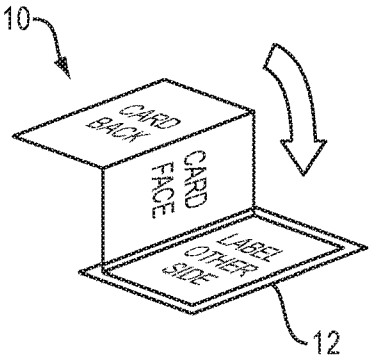

As shown in FIG. 2B, the greeting card portion 14 is folded in a Z-fold configuration (although a "barrel fold" configuration (well known in the art) is also contemplated by the present invention) onto the back of the label portion 12 as shown in FIG. 2C. Once the adhesive release layer 18 (for example a silicone coated paper layer) is removed, the adhesive (shown in gray in FIGS. 2A, 2B and 2C) is utilized to adhere the combination shipping label and greeting card onto a package 20, FIG. 2D, with the shipping information (see FIG. 5) prominently displayed and with the greeting card portion 14 including a customized or personalized greeting for the gift recipient safely stored underneath the center/shipping label portion 12 of the combination shipping label and greeting card 10 ready to be released by the recipient as will be described in greater detail below.

Figure 3:
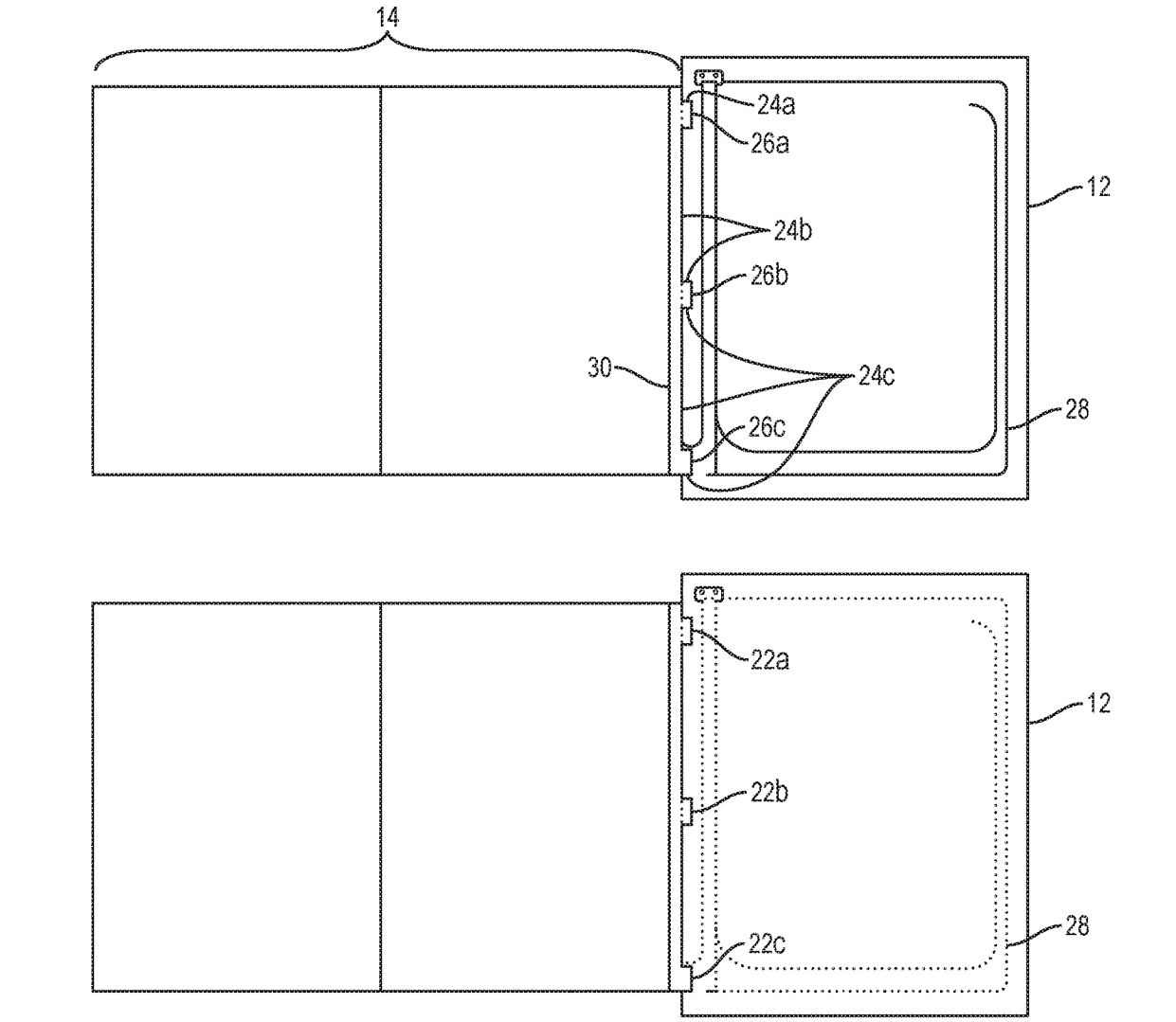
FIG. 3 illustrates the various segments of the combination shipping label and greeting card of the present invention.

As shown in greater detail in FIG. 3, the combination greeting card and shipping label 10 according to the first embodiment of the present invention includes a greeting card portion 14 and a shipping label portion 12. One feature of the first embodiment of the present invention is the provision of three "hinges" 22 that serve to first of all keep the greeting card portion 14 removably attached to the shipping label portion 12 until detached by the recipient, and secondly, allow the greeting card portion 14 to "fold" upon the label portion 12 as previously shown in connection with FIG. 2B. The solid line portions 24 represent die cuts that are made when manufacturing the combination shipping label and greeting card 10 of the invention. Three perforated portions 26 keep the greeting card portion 14 attached to the shipping label portion 12 and allow the greeting card portion 14 to fold upon the shipping label portion 12.

A perforation 28 in the shipping label portion 12 allows the shipping label itself to be removed as will be explained in greater detail in connection with FIG. 5 exposing the greeting card portion 14. A perforation line 30 in the greeting card portion allows the greeting card portion 14 to be removed from the combination shipping label and greeting card once the shipping label face has been removed.

FIG. 5 shows the shipping label face and indicia of the shipping label portion 12 of the combination shipping label and greeting card 10 according to the present invention. All standard shipping information including name and address of the shipper, the recipient as well as appropriate bar codes and other shipping required information can be printed on the surface of the shipping label portion 12. In addition, this portion 12 of the combination shipping label and greeting card 10 of the invention includes, in one embodiment, a small rectangular opening 32 which gives the user access to a pull tab 34 allowing the user to pull the release stripped 36 in the direction shown by arrows 38 around the outside perimeter of the shipping label face which allows the recipient to remove the shipping label face and access the greeting card stored underneath the shipping label face. As previously stated in connection with FIG. 3, the greeting card is not adhesively attached to the package but rather is loose under the shipping label face. The user need only remove the shipping label face as described; access the greeting card portion 14 and tear it along the perforation 30, FIG. 3, to remove the greeting card thereby giving the user access to the greeting card shown in FIGS. 1B-1D in FIG. 1.

Figure 2A:
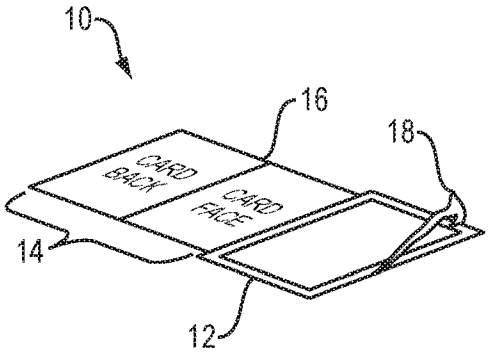
Figure 4:
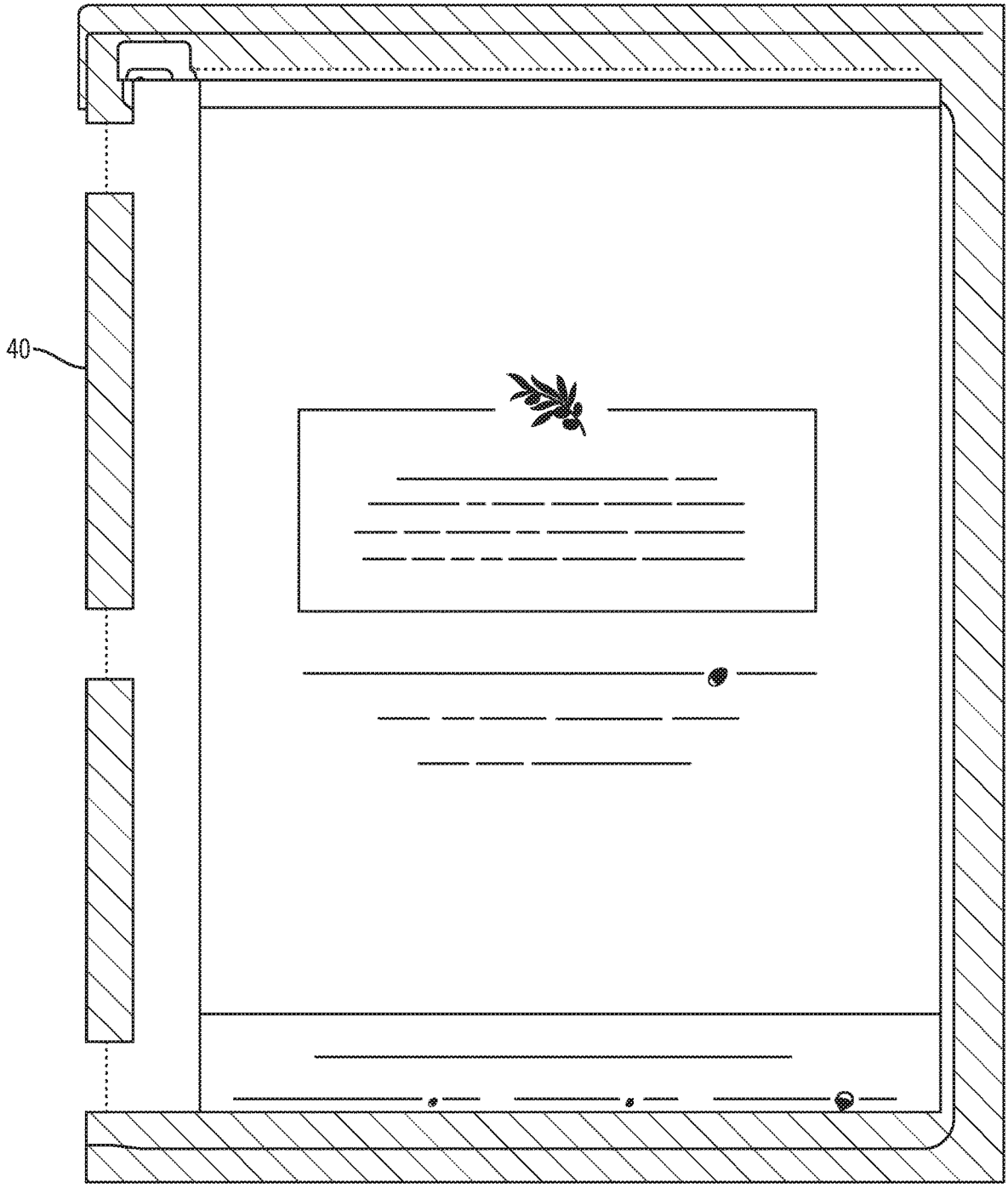
FIG. 4 is a back side view of the combination greeting card and shipping label according to the present invention in a folded condition.

FIG. 4 illustrates the back side of the combination shipping label and greeting card according to the present invention in a folded position. The hashed area 40 which corresponds to the gray area shown in FIGS. 2A-2C is the adhesive that allows the combination shipping label and greeting card 10 of the invention to be adhered to the surface of a package. The adhesive area is covered by a thin release layer 18, FIG. 2A such as a silicone coated paper. Once the greeting card portion 14 is folded onto the shipping label portion 12, the adhesive covering or release layer 18 is removed as shown in FIG. 4 and the label is adhered to the package as shown in FIG. 1A. Because the adhesive covered by release layer 18 is only found on the inner side of the shipping label portion 12 of the combination shipping label and greeting card 10 of the present invention, the inner side of the greeting card portion 14 of the present invention (see FIG. 1B) may also be printed unlike the prior art which utilized shipping label stock having an adhesive layer on the entire insider bottom surface to provide a shipping label with a message printable only on the top or outer surface.

Figure 6:
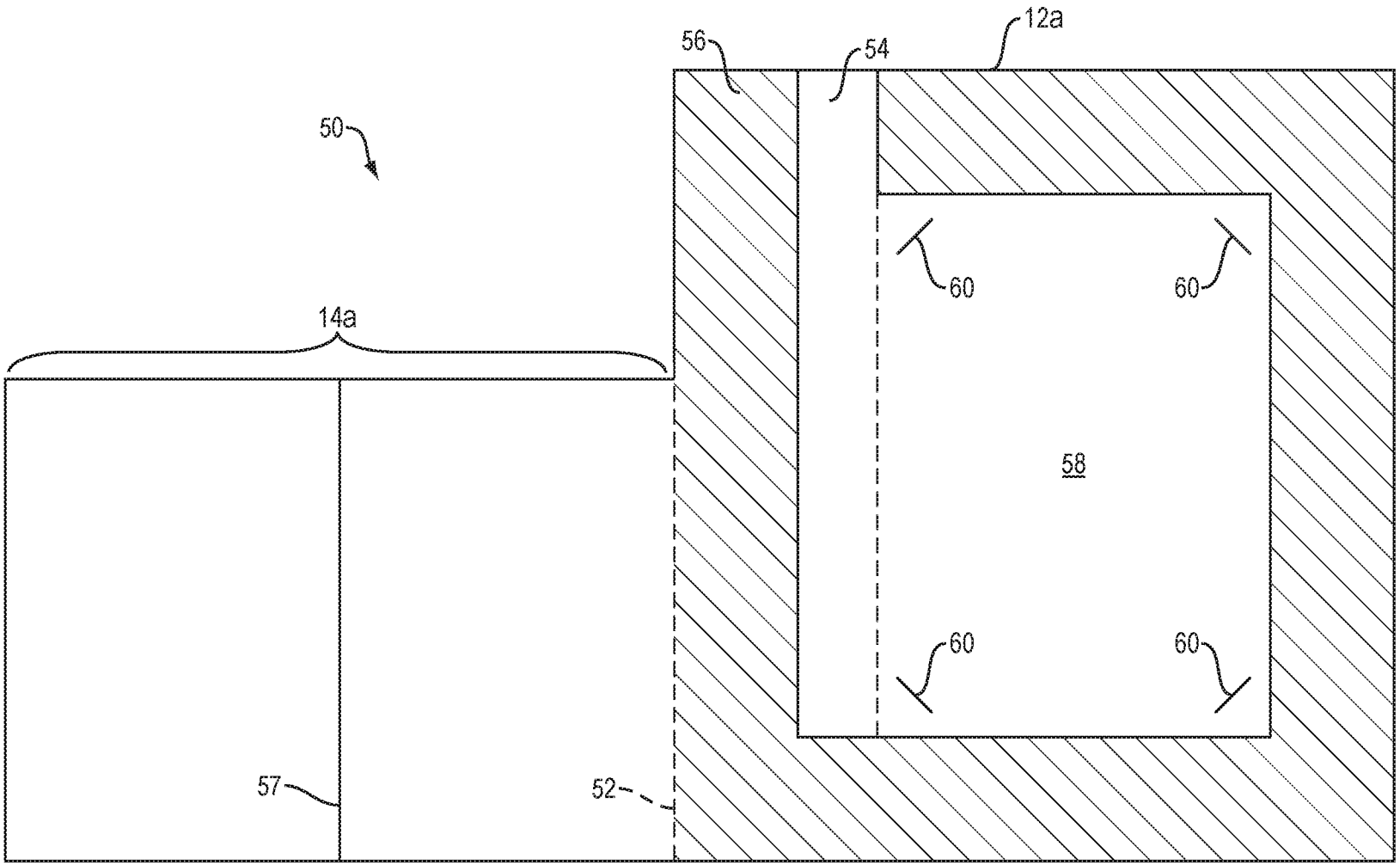
FIG. 6 is a front view of the combination greeting card and shipping label according to a second embodiment of the present invention.

In a second embodiment of the combination shipping label and greeting card 50, FIG. 6, the embodiment includes a greeting card portion 14*a* and a shipping label portion 12*a*. The greeting card portion 14*a* is detachable from the shipping label portion 12 a by means of a perforated edge or line 52.

The entire back or bottom portion 54 of the shipping label portion 12*a* is covered in adhesive, sticky back material over which is provided a silicone coated release paper. In use, that portion of the silicone coated release paper shown in hashed marks and identified generally as 56 is removed to provide a large adhesive surface area to adhere the shipping label and greeting card combination to the package.

Figure 7:
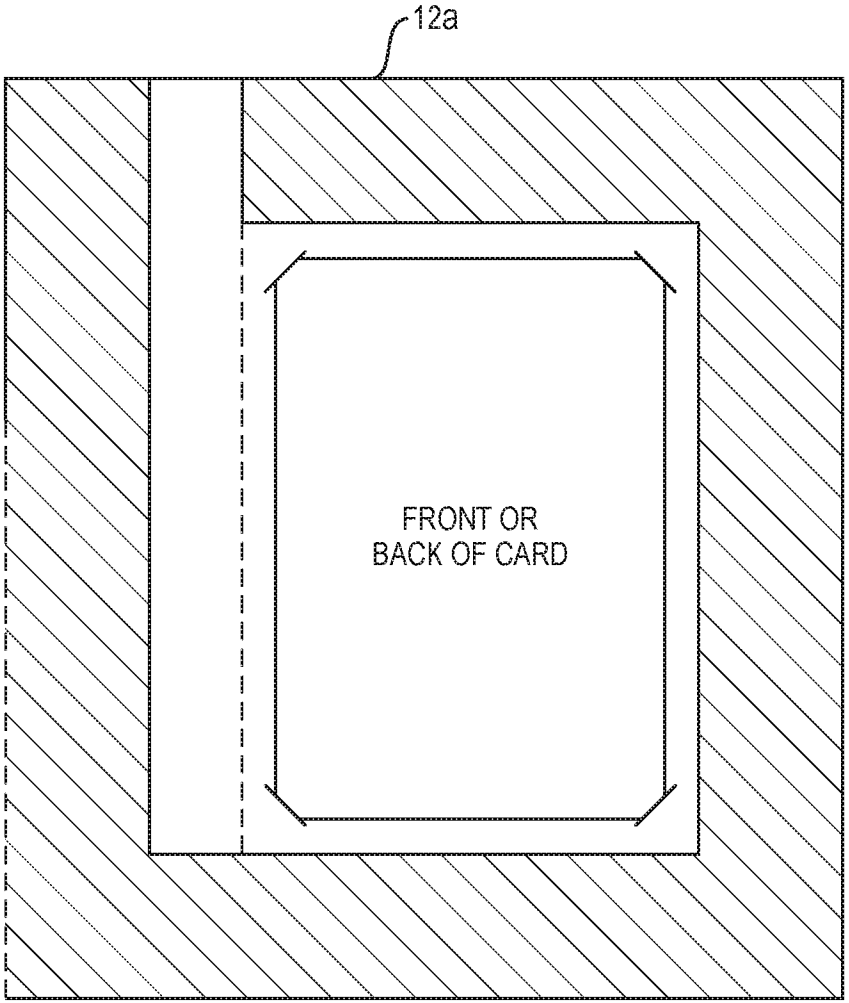
FIG. 7 is a back view of the shipping label portion according to one embodiment of the present invention with the greeting card portion stored in a central region of the shipping label portion.

To use this second embodiment of the combination shipping label and greeting card 50, the greeting card portion 14 a is detached from the shipping label portion 12*a* by tearing along perforated line 52. The card is folded along fold line 57 following which two or more corners of the folded greeting card portion 14*a* are inserted into two or more slots 60 cut into the central back region 58 of the shipping label portion 12*a* as shown in FIG. 7. This action produces a product which is similar to that shown in FIG. 2C following which the entire combination greeting card and shipping label 50 is adhered to the package 20 as shown in FIG. 2D.

The second embodiment, however, is somewhat less complex to manufacture in that there is less die cutting of the stock involved. Moreover, that portion of the silicone based release paper 56 which is removed provides a greater or larger area for the shipping label to adhere to the package 20. Subsequently, as discussed and described in connection with FIG. 5, a pull tab 34 perforated as shown in FIG. 5 and pulled in the directions of arrows 38 is utilized to release the greeting card from the shipping label as previously described in connection with the first embodiment.

The greeting curd portion 14 a and the second embodiment is, as described in connection with the first embodiment, customizable he printable on four sides in a different manner for each order.

Accordingly, the present invention provides a combination shipping label and greeting card in which the entire printable surface is exposed and customizably printable by the shipper to include both shipping information as well as a customizable logo or photo as well as greeting (see FIG. 1D) which can be printed by the shipper utilizing a conventional laser printer for example. The back and/or front face of the greeting card portion may be pre-printed with the shipper's or senders general information or any other information the shipper/sender feels is desirable such as advertising, business logos, holiday greetings or the like.

Modifications and substitutions by one of ordinary skill in the art are considered to be within the scope of the present invention, which is not to be limited except by the allowed claims and their legal equivalents.

What is claimed is:

1. A combination shipping label and greeting card, configured for attachment to a shipping package, comprising:

a single, unitary, printable sheet of material, said single, unitary, printable sheet of material comprising a greeting card portion and a shipping label portion;

said greeting card portion configured for being folded and stored under at least a portion of said shipping label portion during shipping, wherein said greeting card portion is detachable from said shipping label portion by means of a perforation between said greeting card portion and said shipping label portion forming a detached greeting card portion; and said shipping label portion having a top surface portion, a bottom surface portion and a central region, said top surface portion configured to receive printed shipping information, said central region configured for containing said folded greeting card portion without said folded greeting card portion being adhered to said shipping package, and said shipping label portion bottom surface including at least one region on which is disposed an adhesive material, said adhesive material configured for affixing said shipping label portion including said folded greeting card portion to a shipping package, and wherein said bottom surface further includes a removable release layer, configured for covering said adhesive material and for preventing said adhesive material disposed on said shipping label portion bottom surface from adhering to an object prior to its intended use of affixing said shipping label portion to said shipping package, wherein said shipping label portion top surface includes an opening in said top surface, said opening disposed adjacent to a pull tab coupled to a release strip disposed along at least first and second edges of said shipping label portion top surface, and configured for allowing a user to pull said release strip around at least a portion of an outside perimeter of said shipping label portion top surface allowing a user to access said greeting card portion disposed in said central region of said shipping label portion and disposed underneath said shipping label portion top surface, and wherein said shipping label portion includes at least two slots cut into said shipping label portion and extending from said bottom surface through said top surface, said two slots disposed diagonally opposite one another and configured for allowing first and second corner regions of said detached greeting card portion to be inserted into said two slots, for holding said greeting card portion under said shipping label portion during shipping and prior to release by an end user.

2. The combination shipping label and greeting card of claim 1, wherein said single, unitary, printable sheet of material is made from card stock material.

3. The combination shipping label and greeting card of claim 1, wherein said greeting card portion includes at least one fold line configured for allowing said greeting card portion to be folded.

4. The combination shipping label and greeting card of claim 1, wherein said entire shipping label portion bottom surface includes said adhesive material on which is disposed said removable release layer, and wherein said removable release layer is configured for being removed from only a portion of said bottom surface of said shipping label portion for affixing said shipping label portion to said shipping package.

5. The combination shipping label and greeting card of claim 1, wherein said greeting card portion includes at least one fold line configured for allowing said greeting card portion to be folded.

6. The combination shipping label and greeting card of claim 1, wherein at least said top surface of said shipping label portion and at least one surface of said greeting card portion are configured for being printed on demand prior to said shipping label portion being attached to said shipping package.

7. The combination shipping label and greeting card according to claim 1 wherein said release strip is disposed along at least first, second and third edges of said shipping label portion top surface.

8. A combination shipping label and greeting card, configured for attachment to a shipping package, comprising:

a single, unitary, printable sheet of material, said single, unitary, printable sheet of material comprising a greeting card portion and a shipping label portion, wherein said single, unitary, printable sheet of material is made from card stock material;

said greeting card portion including at least one fold line and configured for allowing said greeting card portion to be folded and stored under at least a portion of said shipping label portion during shipping, wherein said greeting card portion is detachable from said shipping label portion by means of a perforation between said greeting card portion and said shipping label portion forming a detached greeting card portion;

said shipping label portion having a top surface portion, a bottom surface portion and a central region, said top surface portion configured to receive printed shipping information, said central region configured for containing said folded greeting card portion without said folded greeting card portion being adhered to said shipping package, and said shipping label portion bottom surface including at least one region on which is disposed an adhesive material, said adhesive material configured for affixing said shipping label portion including said folded greeting card portion to a shipping package, and wherein said bottom surface further includes a removable release layer, configured for covering said adhesive material and for preventing said adhesive material disposed on said shipping label portion bottom surface from adhering to an object prior to its intended use of affixing said shipping label portion to said shipping package, wherein said entire shipping label portion bottom surface includes said adhesive material on which is disposed said removable release layer, and wherein said removable release layer is configured for being removed from only a portion of said bottom surface of said shipping label portion for affixing said shipping label portion to said shipping package, and wherein said shipping label portion further includes at least two slots cut into said shipping label portion and extending from said bottom surface through said top surface, said two slots disposed diagonally opposite one another and configured for allowing first and second corner regions of said detached greeting card portion to be inserted into said two slots, for holding said greeting card portion under said shipping label portion during shipping and prior to release by an end user;

wherein at least said top surface of said shipping label portion and at least one surface of said greeting card portion are configured for being printed on demand prior to said shipping label portion being attached to said shipping package and wherein said shipping label portion top surface includes an opening in said top surface, said opening disposed adjacent to a pull tab coupled to a release strip disposed along at least first and second edges of said shipping label portion top surface, and configured for allowing a user to pull said release strip around at least a portion of an outside perimeter of said shipping label portion top surface allowing a user to access said greeting card portion disposed in said central region of said shipping label portion and disposed underneath said shipping label portion top surface.

9. The combination shipping label and greeting card according to claim 8 wherein said release strip is disposed along at least first, second and third edges of said shipping label portion top surface.

* * * * *